US011613848B2

(12) United States Patent
Lippi Alves Fernandes

(10) Patent No.: US 11,613,848 B2
(45) Date of Patent: Mar. 28, 2023

(54) MACHINE AND METHOD FOR PRODUCING A FIBROUS WEB

(71) Applicant: VOITH PATENT GMBH, Heidenheim (DE)

(72) Inventor: Ademar Lippi Alves Fernandes, Me Brummen (NL)

(73) Assignee: Voith Patent GmbH, Heidenheim (DE)

( * ) Notice: Subject to any disclaimer, the term of this patent is extended or adjusted under 35 U.S.C. 154(b) by 97 days.

(21) Appl. No.: 17/279,191

(22) PCT Filed: Jul. 18, 2019

(86) PCT No.: PCT/EP2019/069328
§ 371 (c)(1),
(2) Date: Mar. 24, 2021

(87) PCT Pub. No.: WO2020/064167
PCT Pub. Date: Apr. 2, 2020

(65) Prior Publication Data

US 2022/0049425 A1 Feb. 17, 2022

(30) Foreign Application Priority Data

Sep. 24, 2018 (DE) ..... 102018123390.6

(51) Int. Cl.
*D21F 7/08* (2006.01)
*D21F 3/02* (2006.01)
(Continued)

(52) U.S. Cl.
CPC ..... *D21F 7/083* (2013.01); *D21F 3/029* (2013.01); *D21F 11/14* (2013.01); *D21H 27/002* (2013.01)

(58) Field of Classification Search
CPC ..... D21F 7/083; D21F 3/029; D21F 11/14; D21F 9/00; D21H 27/002
See application file for complete search history.

(56) References Cited

U.S. PATENT DOCUMENTS 3,301,746 A 1/1967 Sanford et al.
5,182,164 A 1/1993 Eklund et al.
(Continued)

FOREIGN PATENT DOCUMENTS

DE 1461271 A1 11/1968
DE 4232319 A1 3/1994
(Continued)

*Primary Examiner* — Eric Hug
*Assistant Examiner* — Matthew M Eslami
(74) *Attorney, Agent, or Firm* — Laurence A. Greenberg; Werner H. Stemer; Ralph E. Locher

(57) ABSTRACT

A machine for producing a fibrous web, such as a tissue web, has pressing device with a pressing element and a counter-element with a closed surface for forming a pressure nip. A water-absorbing belt with a web side and an opposite pressing element side is guided together with the fibrous web through the pressure nip and the fibrous web is separated at the end of the pressure nip from the web side of the water-absorbing belt and runs further with the counter-element. The water-absorbing belt has at least a first ply and a second ply, and, as viewed in the thickness direction of the water-absorbing belt, a layer in or on the belt half which faces the pressing element, which layer has a higher specific throughflow resistance than the first ply and/or the second ply.

20 Claims, 2 Drawing Sheets

(51) Int. Cl.
*D21F 11/14* (2006.01)
*D21H 27/00* (2006.01)

(56) References Cited

U.S. PATENT DOCUMENTS

| | | | | |
|---|---|---|---|---|
| 5,601,691 | A | 2/1997 | Kufferath | |
| 6,071,837 | A | 6/2000 | Crook | |
| 6,235,160 | B1 | 5/2001 | Tietz et al. | |
| 7,128,810 | B2 | 10/2006 | Hansen | |
| 2005/0167067 | A1* | 8/2005 | Crook ..... | D21F 3/029<br>139/425 A |
| 2006/0258246 | A1 | 11/2006 | Bomberger et al. | |

FOREIGN PATENT DOCUMENTS

| | | | |
|---|---|---|---|
| DE | 60320667 | T2 | 5/2009 |
| EP | 0878579 | A2 | 11/1998 |
| EP | 0926296 | B1 | 7/2004 |
| EP | 1712675 | A1 | 10/2006 |

* cited by examiner

MACHINE AND METHOD FOR PRODUCING A FIBROUS WEB

BACKGROUND OF THE INVENTION

Field of the Invention

The invention relates to a machine for producing a fibrous web, in particular a tissue web, having at least one pressing device which comprises a pressing element and an opposing element with a closed surface for forming a press nip, and having a water-absorbing belt with a web side and an opposite pressing element side, which can be guided together with the fibrous web through the press nip in such a way that the fibrous web is separated from the web side of the water-absorbing belt at the end of the press nip and runs further with the opposing element.

The invention also relates to a method for producing a fibrous web, and a water-absorbing belt for use in a machine for producing a fibrous web.

Machines of the aforementioned type are known. The document EP 0 926 296 B1 shows a machine for producing a tissue web. In the forming area, a felt belt is led partly around a forming roll together with a forming fabric, forming an inlet gap. Via a headbox, a fibrous material suspension from which the tissue web is formed is fed into the inlet gap. After the forming roll, the forming fabric is guided away and the tissue web lying on the felt belt is guided to a press nip, which is formed by a shoe roll and a Yankee drying cylinder. After the press nip, the tissue web runs onward with the Yankee drying cylinder for further drying. In the loop formed by the felt belt, before the press nip, an evacuated device is provided to act on the felt belt and the tissue web carried along.

It is also known to arrange a suction element for conditioning the felt belt between the press nip and the forming area outside the loop formed by the felt belt. Such suction elements are also known as a Uhle box. As a result of the conditioning, the water contained in the felt belt is removed before the fibrous material suspension is discharged.

SUMMARY OF THE INVENTION

The object of the invention is to specify a machine and a circulating belt and a method for reducing the expenditure of energy for the conditioning of the circulating belt.

The object is achieved by features as claimed. A machine for producing a fibrous web, in particular a tissue web, having at least one pressing device which comprises a pressing element and an opposing element with a closed surface for forming a press nip, and having a water-absorbing belt with a web side and an opposing pressing element side, which can be guided together with the fibrous web through the press nip in such a way that the fibrous web is separated from the web side of the water-absorbing belt at the end of the press nip and runs further with the opposing element is. According to the invention, the water-absorbing belt (3) comprises at least a first ply (15) and a second ply (16), and, as viewed in the thickness direction of the water-absorbing belt (3), the belt (3) has a layer (18) on the half which faces the pressing element (7), which layer (18) has a higher specific throughflow resistance than the first ply (15) and/or the second ply (16).

As a result of the higher throughflow resistance, the layer prevents or minimizes the water contained in the pressing-element-side half of the water-absorbing belt flowing back in the direction of the web side. The water can thus be removed more easily by a suction device arranged on the pressing element side. The throughflow resistance of a ply or layer can be determined, for example, by water flowing through the ply or layer in the thickness direction on a throughflow area at a predefined pressure difference and, in the process, the throughflow volume flow being measured and related to the thickness of the ply or layer. If the throughflow resistance of various plies or layers is to be compared, the boundary conditions must be kept constant.

Advantageously, the first ply forms the web side and preferably comprises a laid fiber fabric made of plastic fibers. The first ply can be formed in the manner of a felt. The plastic fibers can be connected to the second ply, for example needled.

The second ply can be a woven ply and the first ply can preferably be connected to the second ply, in particular needled.

The layer is advantageously connected to the second ply.

Furthermore, the layer can be connected to the second ply and form the pressing element side of the water-absorbing belt.

It is also conceivable that the layer forms the pressing element side. In this case, it forms the running side of the water-absorbing belt and is in contact with the pressing element. The layer can be optimized with regard to low wear as a result of mechanical abrasion and at the same time with regard to the throughflow resistance.

In addition, a further ply, which preferably comprises a laid fiber fabric made of plastic fibers, can be provided on the half of the water-absorbing belt which faces the pressing element. The further ply can be needled with the layer and/or with the second ply.

In a practical embodiment, the layer can be arranged between the second ply and the further ply.

It is also possible to arrange the layer within the further ply.

In a possible further configuration, the layer can be arranged adjacent to the further ply and form the pressing element side.

The water-absorbing belt can be embodied as a press felt.

In a possible development, the layer can be embodied as a membrane with openings. This can be, for example, a plastic film with needled or punched or laser-drilled holes.

It is also possible to embody the layer as a laid fiber fabric made of fine fibers. The fiber fineness can preferably be less than or equal to 3 dtex.

The layer can preferably at least partly comprise components made of thermoplastic polyurethane elastomer (TPU).

In a possible development, the water-absorbing belt is guided on a section by the pressing element after the end of the press nip.

Furthermore, in an area of the water-absorbing belt that is free of a fibrous web, a suction device for dewatering the water-absorbing belt can be provided on the pressing element side of the water-absorbing belt.

As a result of guiding the water-absorbing belt on a section lying on the pressing element, the water-absorbing belt is immediately separated from the fibrous web at the end of the press nip, and thus re-wetting is counteracted. The arrangement of the suction device inside the loop formed by the water-absorbing belt to condition the water-absorbing belt has the advantage that the water contained in the belt can be removed with little energy. This is assisted by the negative pressure arising in the pocket between the water-absorbing belt and pressing element. The water thrown back from the surface of the pressing element by the centrifugal force on the water-absorbing belt can thus be removed directly from the surface of the belt by the suction device.

In a practical configuration, the opposing element is formed by a drying cylinder, in particular by a Yankee drying cylinder.

In a further possible configuration, the pressing element is formed by a press roll, preferably having an open, preferably grooved and/or drilled, surface.

If the press roll has an open surface, then the effect of the invention is particularly advantageous, since the water collected in the open surface and thrown off at the end of the press nip is removed directly from the inner side of the water-absorbing belt by the suction device.

The pressing element can also be formed by a shoe press unit. The effect of the invention is particularly advantageous when a shoe press is used, since greater quantities of water have to be carried away.

The open surface can comprise holes embodied as blind holes.

In a practical case, the shoe press unit can comprise a water-impermeable cover and a press shoe that is arranged inside the cover and can be pressed against the opposing element.

Furthermore, the side of the cover that faces the pressing element side of the water-absorbing belt can have an open, preferably grooved and/or drilled, surface. With an open surface, the effect of the invention is also particularly advantageous here, since the water collected in the open surface and thrown off to the belt at the end of the press nip is removed directly from the inner side of the water-absorbing belt by the suction device.

Preferably, the section is chosen such that the direction of the water-absorbing belt that is guided away assumes an angle of more than 10°, in particular more than 15°, preferably in the region of 20°, relative to a tangent to the opposing element at the end of the press nip. As a result, re-wetting of the fibrous web by the water-absorbing belt is counteracted.

Furthermore, the suction device can have a covering having openings, which are preferably embodied as drilled holes and/or slots.

Advantageously, the machine can be embodied as a Crescent former. Here, the fibrous web is guided from the forming area as far as the press nip on the water-absorbing belt.

The object of the invention is also achieved by a method for producing a fibrous web, in particular a tissue web, having at least one pressing device, which comprises a pressing element and an opposing element with a closed surface for forming a press nip, and having a water-absorbing belt with a web side and an opposite pressing element side which, together with the fibrous web, is guided through the press nip in such a way that the fibrous web is separated from the web side of the water-absorbing belt at the end of the press nip and runs further with the opposing element. It is important to the invention that the water-absorbing belt comprises at least a first ply and a second ply, and that, as viewed in the thickness direction of the water-absorbing belt, the belt has a layer on the half which faces the pressing element, which layer has a higher specific throughflow resistance than the first ply and/or the second ply.

Further features and advantages of the invention emerge from the following description of preferred exemplary embodiments with reference to the drawings.

DETAILED DESCRIPTION OF THE INVENTION

Figure 1:
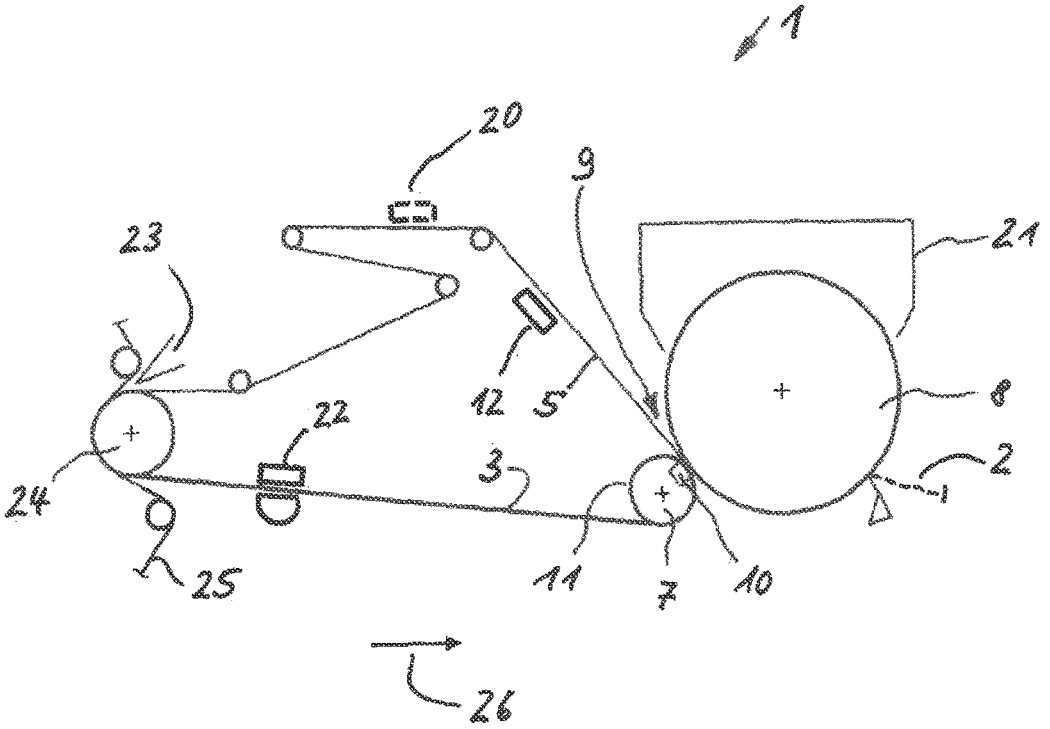
FIG. 1 shows an embodiment of a machine according to the invention for producing a fibrous web in a schematic illustration.

FIG. 1 shows an embodiment of a machine 1 according to the invention for producing a fibrous web 2 in a schematic illustration. In the forming area, a water-absorbing belt 3 together with an outer fabric 25 is guided partly around a forming roll 24, forming an inlet gap. Via a headbox 23, a fibrous material suspension, from which the fibrous web 2 is formed, is fed into the inlet gap. After the forming roll 24, the outer fabric 25 is guided away and the fibrous web 2, lying on the web side 4 of the water-absorbing belt 3, is guided to a pressing device 6 having a press nip 9, which is formed between a pressing element 7 and a Yankee drying cylinder 8. In this example, the pressing element 7 is formed by a shoe roll 7. The cylindrical surface of the Yankee drying cylinder 8 is smooth. After the press nip 9, the fibrous web 2 runs further with the Yankee drying cylinder 8 through a hood 21 for further drying by means of impact drying and is creped by a creping doctor and taken off and guided to a further machine section. Inside the loop formed by the water-absorbing belt 3, before the press nip 9, an evacuated suction roll—not illustrated here—or a suction element 22 for evacuating the water-absorbing belt 3 and the entrained fibrous web 2 can be provided. To increase the dewatering performance, a steam- or hot-air blower hood can be arranged opposite the suction element 22. Between the press nip 9 and the forming area, a suction device 12 for conditioning the water-absorbing belt 3 is arranged inside the loop formed by the water-absorbing belt 3. The suction device 12 has a covering with openings through which the water is sucked into the suction element and which are preferably embodied as holes and/or slots. The suction device 12 is arranged in an area in which the water-absorbing belt 3 is free of a fibrous web 2. As a result, the conditioning is made easier and improved. By means of the suction device 12, the water from the water-absorbing belt 3 is guided away toward the inner side, i.e. toward the pressing element side 5. The shoe roll 7 comprises a press shoe 10, which can be pressed against the Yankee drying cylinder 8 to produce a pressing pressure in the press nip. Between the press shoe 10 and the fibrous web 2, the cover 11 surrounding the press shoe 10 runs through the press nip 9. To increase the dewatering of the fibrous web 2 in the press nip 9, the side of the cover 11 that comes into contact with the pressing element side 5 of the water-absorbing belt 3 has grooves. The water pressed out of the fibrous web 2 in the area of the press nip 9 passes partly through the water-absorbing belt 3 into the grooves of the cover 11 and, after the press nip 9, is partly thrown against the pressing element side 5 of the water-absorbing belt 3 as a result of the centrifugal force. Thus, the water-absorbing belt 3 is re-wetted. This water thrown off can be removed efficiently and with little expenditure of energy as a result of the arrangement according to the invention of the suction device 12, without having to be sucked through the entire thickness of the water-absorbing belt 3. In addition, as viewed in the running direction 26 of the water-absorbing belt 3, a suction element 20 can be arranged downstream of the suction device 12 if necessary.

Figure 2:
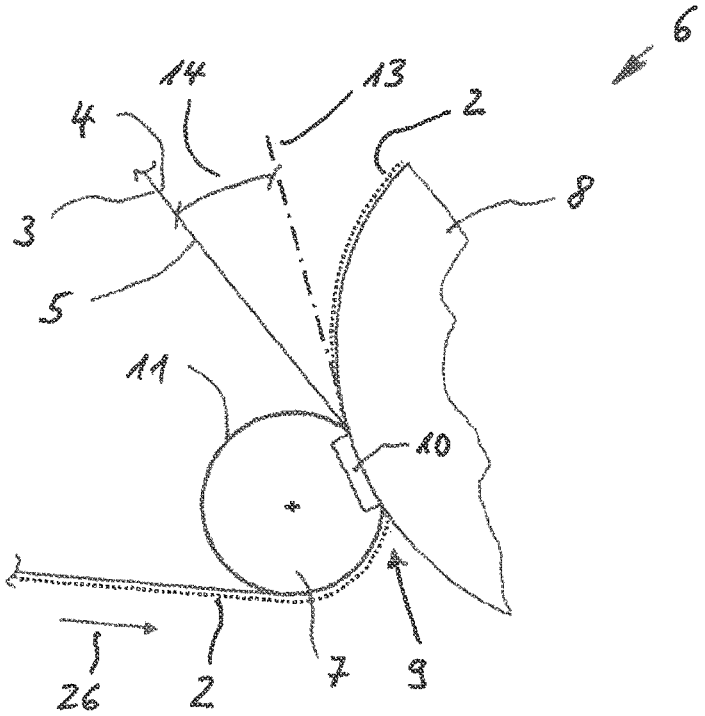
FIG. 2 shows an embodiment of a pressing device of the machine according to the invention in a schematic illustration.

FIG. 2 shows an embodiment of a pressing device 6 of the machine 1 according to the invention in a schematic illustration. The fibrous web 2, lying on the web side 4 of the water-absorbing belt 3, is guided to a pressing device 6 having a press nip 9, which is formed between a pressing element 7 and a Yankee drying cylinder 8. In this example, the pressing element 7 is formed by a shoe roll 7. The cylindrical surface of the Yankee drying cylinder 8 is smooth. The shoe roll 7 comprises a press shoe 10, which can be pressed against the Yankee drying cylinder 8 to produce a pressing pressure in the press nip 9.

Between the press shoe 10 and the fibrous web 2, the cover 11 surrounding the press shoe 10 runs through the press nip 9. To increase the dewatering of the fibrous web 2 in the press nip 9, the side of the cover 11 that comes into contact with the pressing element side 5 of the water-absorbing belt 3 has an open surface, in this example grooves. The water pressed out of the fibrous web 2 in the area of the press nip 9 passes partly through the water-absorbing belt 3 into the grooves of the cover 11.

After the end of the press nip 9, the water-absorbing belt 3 is guided on a section through the pressing element 7. The length of the section is chosen such that the direction of the water-absorbing belt 3 guided away assumes an angle 14 of more than 10°, in particular more than 15°, preferably in the region of 20°, to a tangent 12 to the opposing element 8 at the end of the press nip. As a result, re-wetting of the fibrous web 2 by the water-absorbing belt 3 is counteracted. The conditioning of the water-absorbing belt 3 is assisted by the negative pressure produced in the pocket between the water-absorbing belt 3 and the pressing element 7.

Figure 3:
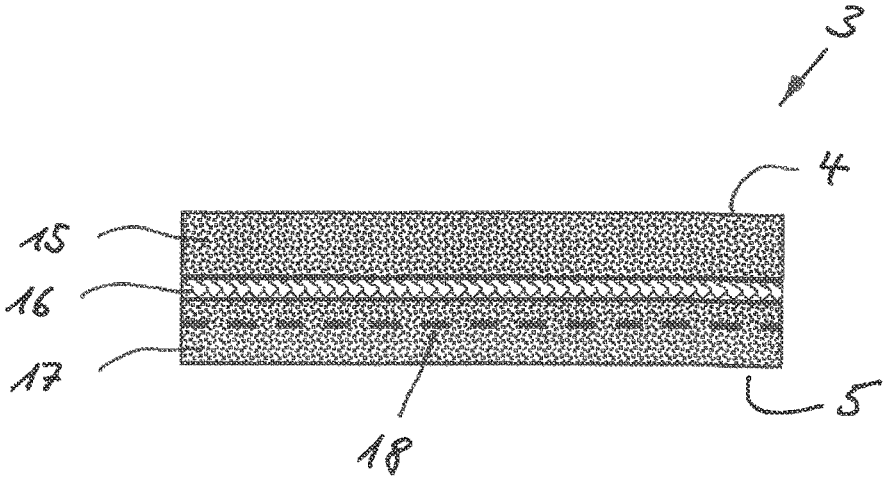
FIG. 3 shows an embodiment of a water-absorbing belt of a machine according to the invention for producing a fibrous web in a schematic illustration.

In FIG. 3, an embodiment of a water-absorbing belt 3 of a machine 1 according to the invention for producing a fibrous web 2 is shown in a schematic illustration. The water-absorbing belt 3 comprises a first ply 15, a second ply 16, a further ply 17 and a layer 18, which has a higher specific throughflow resistance than the first ply 15 and/or the second ply 16 and/or the further ply 17. The web side 4 is formed by the first ply 15 and the pressing element side 5 by the further ply 17. As viewed in the thickness direction of the water-absorbing belt 3, the layer 18 is arranged on the half which faces the pressing element 7. The higher throughflow resistance of the layer 18 prevents or minimizes the water contained in the pressing-element-side half of the water-absorbing belt 3 flowing back in the direction of the web side 4. The water can thus be removed more easily by the suction device 12 arranged on the pressing element side 5. The first ply 15 forming the web side 4 comprises a felt-like laid fiber fabric and is needled with the second ply 16. The second ply 16 is a woven ply. In this example, the layer 18 is incorporated into the further ply 17 between the second ply 16 and the pressing element side 5 and is thus located within the further ply 17. The layer 18 can also adjoin the second ply 16 directly and be connected thereto, for example by needling. The further ply 17 forming the pressing element side likewise comprises a felt-like laid fiber fabric and is needled with the second ply 16. The layer 18 is embodied as a membrane with openings. This can be, for example, a plastic film with needled or punched or laser-drilled holes. Within the context of the invention, it is also possible to embody the layer 18 as a laid fiber fabric made of fine fibers. The fiber fineness can preferably be less than or equal to 3 dtex. The layer 18 at least partly contains components of thermoplastic polyurethane elastomer (TPU). This increases the elasticity of the belt 3.

Figure 4:
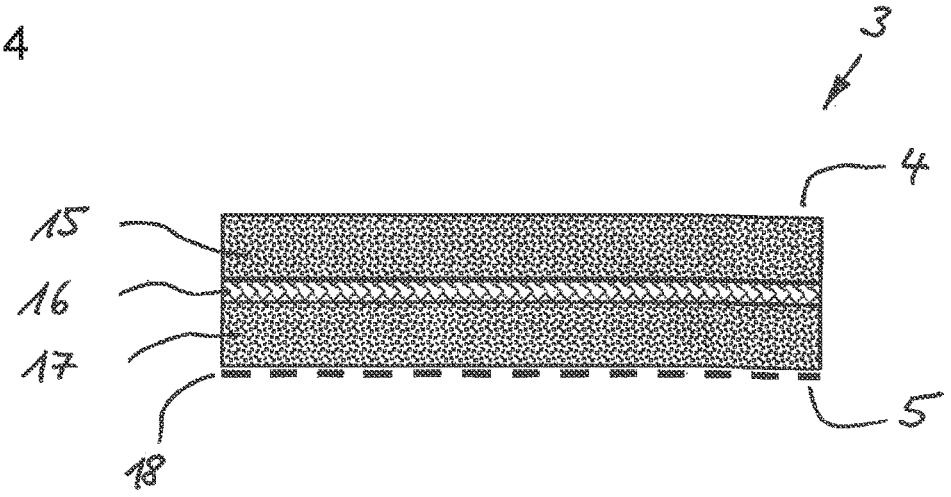
FIG. 4 shows a further embodiment of a water-absorbing belt of a machine according to the invention for producing a fibrous web in a schematic illustration.

In FIG. 4, a further embodiment of a water-absorbing belt 3 of a machine 1 according to the invention for producing a fibrous web 2 is shown in a schematic illustration. It differs from the embodiment in FIG. 4 only in the arrangement of the layer 18 in the thickness direction of the water-absorbing belt 3. The layer 18 is connected to the further ply 17 and forms the pressing element side 5 of the water-absorbing belt 3. In the machine 1, the layer 18 comes into contact with the pressing element 7. The layer 18 is optimized with regard to low wear as a result of mechanical abrasion and at the same time with regard to the throughflow resistance.

Corresponding elements of the exemplary embodiments are provided with the same designations in the figures. The functions of such elements in the individual figures correspond to one another, if not otherwise described and it does not lead to contradictions. A repeated description is therefore omitted. It is also pointed out that different features of the exemplary embodiments shown can be interchanged with one another and combined with one another. The invention is therefore not restricted to the feature combinations shown of the exemplary embodiments shown.

LIST OF REFERENCE SYMBOLS

1 Machine
2 Fibrous web
3 Water-absorbing belt
4 Web side
5 Pressing element side
6 Pressing device
7 Pressing element
8 Opposing element, drying cylinder
9 Press nip
10 Press shoe
11 Cover
12 Suction device
13 Tangent
14 Angle
15 First ply
16 Second ply
17 Further ply
18 Layer
19 Press felt
20 Sucker
21 Hood
22 Suction element
23 Headbox
24 Forming roll
25 Outer fabric, forming fabric
26 Running direction

The invention claimed is:

1. A machine for producing a fibrous web, the machine comprising:

at least one pressing device having a press nip formed by a pressing element and an opposing element being a drying cylinder with a closed surface;

a water-absorbing belt having a web side and an opposite pressing element side;

wherein, during an operation of the machine, said water-absorbing belt is guided together with the fibrous web through said press nip and the fibrous web is separated from said web side of said water-absorbing belt upon issuing from said press nip, and the fibrous web runs further on the closed surface of said drying cylinder;

said water-absorbing belt having at least a first ply and a second ply, and, viewed in a thickness direction of said water-absorbing belt, a layer on a half of said water-absorbing belt that faces said pressing element;

said layer having a specific throughflow resistance that is higher than a specific throughflow resistance of at least one of said first ply or said second ply.

2. The machine according to claim 1, wherein said first ply forms the web side of said water-absorbing belt.

3. The machine according to claim 1, wherein said second ply is a woven ply and said first ply is connected to said second ply.

4. The machine according to claim 3, wherein said first ply is a non-woven formed of plastic fibers and said first ply is needled to said second ply.

5. The machine according to claim 1, wherein said layer is connected to said second ply.

6. The machine according to claim 1, wherein said layer forms the pressing element side of said water-absorbing belt.

7. The machine according to claim 1, which comprises a further ply on a half of said water-absorbing belt which faces said pressing element.

8. The machine according to claim 7, wherein said further ply is a non-woven formed of plastic fibers.

9. The machine according to claim 7, wherein said layer is arranged between said second ply and said further ply.

10. The machine according to claim 7, wherein said layer is arranged within said further ply.

11. The machine according to claim 7, wherein said layer is arranged adjacent said further ply and forms the pressing element side of said water-absorbing belt.

12. The machine according to claim 1, wherein said layer is a membrane with openings formed therein.

13. The machine according to claim 1, wherein said layer is a laid fiber fabric made of fibers having a fiber fineness of less than 3 dtex.

14. The machine according to claim 1, wherein said layer at least partly comprises thermoplastic polyurethane elastomer.

15. The machine according to claim 1, further comprising a suction device for dewatering said water-absorbing belt disposed in an area of said water-absorbing belt that is free of the fibrous web, said suction device being disposed on the pressing element side of said water-absorbing belt.

16. The machine according to claim 1, wherein the drying cylinder is a Yankee Cylinder.

17. A water-absorbing belt for use in a machine for producing a fibrous web, the machine having a pressing device with a press nip formed by a pressing element and an opposing drying cylinder with a closed surface, the water-absorbing belt comprising:

at least a first ply and a second ply, and, as viewed in a thickness direction of the water-absorbing belt, a layer on a half of the water-absorbing belt which faces the pressing element;

said layer having a specific throughflow resistance that is higher than a specific throughflow resistance of at least one of said first ply or said second ply.

18. A method for producing a fibrous web, the method comprising:

providing at least one pressing device with a press nip formed between a pressing element and an opposing drying cylinder having a closed surface;

providing a water-absorbing belt with at least a first ply, a second ply, and, as viewed in a thickness direction of the water-absorbing belt, a layer on a half of the water-absorbing belt which faces toward the pressing element, and wherein the layer has a higher specific throughflow resistance than a specific throughflow resistance of the first ply and/or the second ply; and guiding the water-absorbing belt together with the fibrous web through the press nip such that the fibrous web is separated from a web side of the water-absorbing belt at the end of the press nip and runs further on the closed surface of the drying cylinder.

19. The method according to claim 18, which comprises producing a tissue web.

20. The method according to claim 18, wherein the drying cylinder is a Yankee Cylinder.

* * * * *